US006374918B2

(12) United States Patent
Roberts et al.

(10) Patent No.: US 6,374,918 B2
(45) **Date of Patent: *Apr. 23, 2002**

(54) IN-TUBING WELLBORE SIDETRACKING OPERATIONS

(75) Inventors: John D. Roberts, Spring Texas; James Longbottom, Magnolia; David M. Haugen, League City, all of TX (US); Alex Dawson, Keith; David Duguid, Aberdeen, both of (GB); Frank Middleton, Dubai (SA); Brian Bingham, Pearland; Todd Horst, St. Houston, both of TX (US)

(73) Assignee: Weatherford/Lamb, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/312,140

(22) Filed: May 14, 1999

(51) Int. Cl.[7] ..... E21B 17/10; E21B 23/00; E21B 33/122

(52) U.S. Cl. ..... 166/387; 166/50; 166/191; 166/241.1

(58) Field of Search ..... 166/50, 117.5, 166/117.6, 180, 191, 192, 241.1, 381, 387

(56) References Cited

U.S. PATENT DOCUMENTS

| | | | |
|---|---|---|---|
| 1,804,819 A | 5/1931 | Spencer, Jr. et al. | |
| 3,572,432 A | 3/1971 | Aulick | |
| 4,223,737 A | 9/1980 | O'Reilly | 166/362 |

(List continued on next page.)

FOREIGN PATENT DOCUMENTS

| | | | |
|---|---|---|---|
| WO | PCT/EP95/02252 | 6/1995 | |
| WO | WO98/58151 | 12/1998 | E21B/7/06 |

OTHER PUBLICATIONS

Completion Solutions From TIW, 1990–91 General Catalog, pp. 1–44, TIW Inc.

Whipstocks, Weatherford Enterra, 1997.

US Official Gazette—Patents, entry of U.S. 5,937,955, p. 2476, Aug. 17, 1999.

A Novel Approach to Initialing Multi–Lateral Horizontal Wells, Konopczyski et al, SPE/1ADC 29385, 1995.

Drilling & Completing Multiple Lateral Sections From One Borehole, Brockman et al, Offshore, May 1995.

PCT/GB00/01696 Int'l Search Report (counterpart of present case).

*Primary Examiner*—David Bagnell
*Assistant Examiner*—Jennifer H. Gay
(74) *Attorney, Agent, or Firm*—Moser, Patterson & Sheridan, L.L.P.

(57) ABSTRACT

Methods for wellbore operations in an earth wellbore with tubing within casing in an earth wellbore, the wellbore extending down into earth from an earth surface, the tubing including a tubing string with a lower end and extending down within the casing with the lower end at a point above a lower end of the casing, a tubing-casing annulus between the tubing and the casing sealed by a first sealing apparatus, the method including sealing the lower end of the tubing string with a sealing device to prevent fluid flow therethrough, and sealing the tubing casing annulus with a second sealing apparatus above and spaced apart from the first sealing apparatus. In certain aspects the sealing apparatuses provide upper and lower spaced-apart primary barriers. The methods in additional aspects include making an exit opening through the tubing and an exit opening through the casing, each exit opening located between the first sealing apparatus and the second sealing apparatus. In other aspects the methods include drilling a lateral wellbore from the exit opening through the casing. Apparatus is disclosed that is useful in such methods.

18 Claims, 7 Drawing Sheets

U.S. PATENT DOCUMENTS 4,765,404 A 8/1988 Bailey et al. ..... 166/117.6
4,794,989 A * 1/1989 Mills ..... 166/387
4,796,709 A 1/1989 Lynde et al. ..... 166/55.6
4,887,668 A 12/1989 Lynde et al. ..... 166/55.8
4,984,488 A 1/1991 Lunde et al. ..... 76/115
5,014,778 A 5/1991 Lynde et al. ..... 166/55.6
5,058,666 A 10/1991 Lynde et al. ..... 166/55.6
5,150,755 A 9/1992 Cassel et al. ..... 166/297
5,154,231 A 10/1992 Bailey et al. ..... 166/298
5,195,591 A 3/1993 Blount et al. ..... 166/380
5,199,513 A 4/1993 Stewart et al. ..... 175/73
5,238,062 A 8/1993 Reinholdt ..... 166/241.7
5,246,069 A 9/1993 Glaser et al. ..... 166/156
5,253,710 A 10/1993 Carter et al. ..... 166/298
5,261,488 A 11/1993 Gullet et al. ..... 166/241.7
5,277,251 A 1/1994 Blount et al. ..... 166/117.5
5,291,947 A 3/1994 Stracke ..... 166/187
5,318,115 A 6/1994 Rouse ..... 166/55.7
5,318,122 A 6/1994 Murray et al. ..... 166/313
5,341,873 A 8/1994 Carter et al. ..... 166/117.5
5,390,736 A 2/1995 Budde ..... 166/153
5,409,060 A 4/1995 Carter ..... 166/237
5,423,387 A 6/1995 Lynde ..... 175/61
5,429,187 A 7/1995 Beagrie et al. ..... 166/55.1
5,435,400 A 7/1995 Smith ..... 175/61
5,452,759 A 9/1995 Carter et al. ..... 166/117.6
5,520,252 A * 5/1996 McNair ..... 166/313
5,522,461 A 6/1996 Carter et al. ..... 166/298
5,553,667 A 9/1996 Budde et al. ..... 166/70
5,566,754 A 10/1996 Stokka ..... 166/241.6
5,575,333 A 11/1996 Lirette et al. ..... 166/241.1
5,577,560 A 11/1996 Coronado et al. ..... 166/387
5,584,350 A 12/1996 Schnitker et al. ..... 175/61
5,595,247 A 1/1997 Braddick ..... 166/297
5,598,890 A 2/1997 Richard et al. ..... 166/276
5,636,692 A 6/1997 Haugen ..... 166/298
5,642,787 A 7/1997 Hutchinson ..... 175/269
5,651,415 A 7/1997 Scales ..... 166/250.09
5,680,901 A 10/1997 Gardes ..... 166/313
5,697,438 A 12/1997 Rehbock et al. ..... 166/55.7
5,697,445 A 12/1997 Graham ..... 166/313
5,725,060 A 3/1998 Blount et al. ..... 175/61
5,733,113 A 3/1998 Grupping ..... 418/188
5,735,359 A * 4/1998 Lee et al. ..... 175/269
5,738,178 A 4/1998 Williams et al. ..... 175/61
5,762,143 A 6/1998 Comeau et al. ..... 166/381
5,771,984 A 6/1998 Potter et al. ..... 175/14
5,775,428 A 7/1998 Davis et al. ..... 166/381
5,785,120 A 7/1998 Smalley et al. ..... 166/55
5,785,133 A 7/1998 Murray et al. ..... 175/61
5,787,978 A 8/1998 Carter et al. ..... 166/117.6
5,787,987 A 8/1998 Forsyth et al. ..... 166/313
5,791,417 A 8/1998 Haugen et al. ..... 166/298
5,806,595 A 9/1998 Langford et al. ..... 166/298
5,806,596 A 9/1998 Hardy et al. ..... 166/298
5,806,600 A 9/1998 Halford, Sr. ..... 166/382
5,806,614 A 9/1998 Nelson ..... 175/61
5,810,079 A 9/1998 Lynde et al. ..... 166/55.6
5,813,465 A 9/1998 Terrell et al. ..... 166/298
5,833,003 A 11/1998 Longbottom et al. ..... 155/298
5,842,528 A 12/1998 Johnson et al. ..... 175/45
5,845,707 A 12/1998 Longbottom ..... 166/50
5,845,710 A 12/1998 Longbottom et al. ..... 166/313
5,845,722 A 12/1998 Makohl et al. ..... 175/101
5,853,049 A 12/1998 Keller ..... 166/380
5,871,050 A 2/1999 Dobson et al. ..... 166/278
5,881,816 A 3/1999 Wright ..... 166/376
5,887,655 A 3/1999 Haugen et al. ..... 166/298
5,992,524 A * 11/1999 Graham ..... 166/313
6,024,169 A * 2/2000 Haugen ..... 166/298
6,070,670 A * 6/2000 Carter et al. ..... 166/381

* cited by examiner

IN-TUBING WELLBORE SIDETRACKING OPERATIONS

BACKGROUND OF THE INVENTION

1. Field of the Invention

The present invention is directed to wellbore operations, in-tubing sidetracking operations, wellbore milling procedures, and apparatuses and systems useful in such operations and procedures.

2. Description of Related Art

Many completed wells have one or more strings of tubing extending within casing from the surface (or from a tubing hanger) down within the well to a location above completion apparatus in a completion zone. Typically the interface at the lower end of the tubing string and the interior of well casing is sealed, e.g. with a packer or other sealing device. It is also common for a travel joint between the packer and tubing end to accommodate relative movement between the two.

Often it is desirable to produce the well from alternate zones, including, but not limited to, a location above the packer at the end of the tubing string. In several prior art methods, the tubing string is removed to accomplish a sidetracking operation above the level of the original completion zone. Once the tubing is removed a new annulus or primary barrier is installed above a new tubing-casing exit from which a new lateral wellbore extends.

In various prior art methods, new exits (exit openings through tubing, cement and casing) have been provided, an new lateral wellbores drilled therefrom, with the exits positioned below an existing annulus barrier. Such exits and lateral wellbores have been established using coiled tubing without requiring the use of a rig above the wellbore.

Often it is desirable to move up above a current completion zone due to, e.g., offset distance of a new drainage target which requires a well path beginning at a higher point in the wellbore due to maximum build angles versus the distance a well can be drilled due to friction of pipes pushed around curves in the wellbore.

There has long been a need for an efficient and effective method for re-completing a well in tubing above a previous completion location. There has long been a need for a method that efficiently and effectively provides a suitable opening or window through tubing and casing for drilling a sidetracked lateral wellbore at a desired re-completion location. There has long been a need, recognized by the present inventors, for stabilizing tubing at the desired re-completion location. There has long been a need for such a system and method wherein a new primary barrier is provided without the need to remove an entire tubing string.

SUMMARY OF THE PRESENT INVENTION

The present invention, in certain aspects, provides a method for wellbore operations in an earth wellbore with tubing within casing in an earth wellbore, the wellbore extending down into earth from an earth surface, the tubing comprising a tubing string with a lower end and extending down within the casing with the lower end at a point above a lower end of the casing, a tubing-casing annulus between the tubing and the casing sealed by a first sealing apparatus, the method including sealing the lower end of the tubing string with a sealing device to prevent fluid flow therethrough, and sealing the tubing-casing annulus with a second sealing apparatus above and spaced apart from the first sealing apparatus.

The present invention, in certain embodiments, discloses a through-tubing in-tubing system for providing a tubing/casing exit above a first completion zone in a main wellbore for drilling a new lateral wellbore from the main wellbore. In one embodiment in which a tubing-casing annulus is initially sealed off at a lower end for production below the tubing, another seal is provided within the tubing-casing annulus above and spaced apart from the lower seal. Then the tubing is perforated between the two seal areas, preferably without perforating the casing. In one aspect a travel joint, (including, but not limited to, a commercially available ELTSR receptacle from Baker Oil Tools) part of which encompasses the lower end of the tubing, is also perforated. Cement, resin or other suitable hardenable material is then pumped from the surface, down the interior of the tubing string, out through the perforations, and up into the annulus between the tubing's exterior and the casing's interior to such a level to stabilize a portion of the tubing for making one or more exit openings in the tubing and casing below that cement level.

The exit opening(s) are made with any suitable known apparatuses, equipment and methods, including, but not limited to, with a mill or mills, jet cutter(s), and explosives. In certain aspects, a diverter, mill guide, and/or whipstock is positioned and secured for directing a mill or mills against the tubing and/or casing. A suitable mill or mills are then used to make the exit opening(s) or window(s). In one aspect the mill or mills are run on a string rotatable from the surface. In another aspect, a coiled tubing string is used that includes a downhole motor for rotating a mill. Such a coiled tubing string may be used within the tubing that does not necessitate removal of the tubing string from the well or removal of a wellhead at the surface. The emplacement of the seal apparatus and perforating of the tubing can also be done without removal of the wellhead.

Once the exit opening(s) are provided, a lateral wellbore may be drilled out ("sidetracked") from the casing exit as desired. The lateral wellbore may then be lined or cased as is well known in the art.

In another embodiment, following sealing of the tubing, cementing, and sidetracking, a jet cutter is lowered into the tubing to sever the tubing above the sealing apparatus. The entire tubing string is then raised at the surface and re-hung to provide a desired gap, e.g. of 30 feet in length, at a desired location down in the wellbore for installing a new upper primary barrier.

In yet another embodiment, following sealing of the tubing, cementing, and sidetracking as described above, an explosive device according to the present invention is run into the tubing and positioned adjacent the area at which a tubing gap is desired. One or more selectively activatable holding subs, e.g. but not limited to, the "button subs" or "hold downs" disclosed in U.S. Pat. No. 5,785,120, are activated by pumping fluid under pressure down the tubing string to secure the explosive device in position. Alternatively mechanical anchors or the like may be used. A fluid pressure-activated firing head of the explosive device is activated by pumping fluid under pressure down the tubing string. The firing head simultaneously fires three separate charges: 1. a top charge that severs the tubing at a top level; 2. a bottom charge that severs the tubing at a bottom level; and 3. a slotting charge that fires to produce a series of longitudinal slots and corresponding fingers in and around the severed tubing. The explosive device is connected at the end of a tubing or coiled tubing string which is then lowered, pushing the housing of the explosive device down into the remaining tubing. The button sub(s) hold the severed tubing and, as the severed tubing is lowered, the fingers go down between the tubing's exterior and the casing's interior, creating an open axial gap in the tubing. The button sub(s) are then released and the housing of the explosive device is retrieved from the tubing. A sealing apparatus, e.g. an inflatable packer or, a mechanical packer, either of which may be a through-tubing packer or, is then run into the tubing on a tubing string or on coiled tubing and positioned at the gap in the tubing. Activating the packer seals off the tubing/casing annulus. The string is then released from the packer and retrieved from the wellbore.

In another embodiment a system with a mill and a downhole motor on coiled tubing is positioned with a mill adjacent the desired location for removal of a section of the tubing. The system is secured in place within the tubing with any suitable securement apparatus, including, but not limited to, one or more of the button subs discussed above. The system also includes a movement or stroking apparatus, e.g., but not limited to, as disclosed in FIGS. 1A–1E of U.S. Pat. No. 5,785,120 and accompanying text or in U.S. application Ser. No. 09/183,943 filed Oct. 31, 1998. The coiled tubing string includes a downhole motor that rotates the mill as the stroking apparatus pulls the coiled tubing and, hence, the mill upwardly to mill out the desired gap in the tubing. Depending on the length of the stroke of the stroking apparatus and the length of a desired milled gap in the tubing, more than one stroke may be needed. Alternatively any known milling or cutting system and method, including those in which a mill mills downwardly upwardly, or both and is supported from the surface and/or within the tubing below the surface may be used.

In any method described herein the stabilization and/or perforating and cementing steps may be optional. It is also to be understood that whenever a sealing apparatus is mentioned it may, within the scope of this invention, be any known suitable inflatable or mechanical packer (including but not limited to hydraulically set packers, mechanically set packers, and hydraulically set mechanical packers).

It is, therefore, an object of at least certain preferred embodiments of the present invention to provide:

- New, useful, unique, efficient, and novel and nonobvious methods for re-completing a well above a previous completion zone;
- Such methods which do not require removal of a wellhead and related equipment from a wellbore;
- Such methods which provide a new primary barrier around a tubing string above a new completion zone;
- Such methods which do not require re-installation of a drilling rig;
- Such methods which employ stabilization of a portion of tubing in a wellbore prior to making a tubing exit through that tubing portion;
- Such methods which do not require the removal of a tubing string to provide a new exit above a previous completion zone in an area through which a tubing string extends; and
- Apparatus and equipment useful in such methods.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1D:
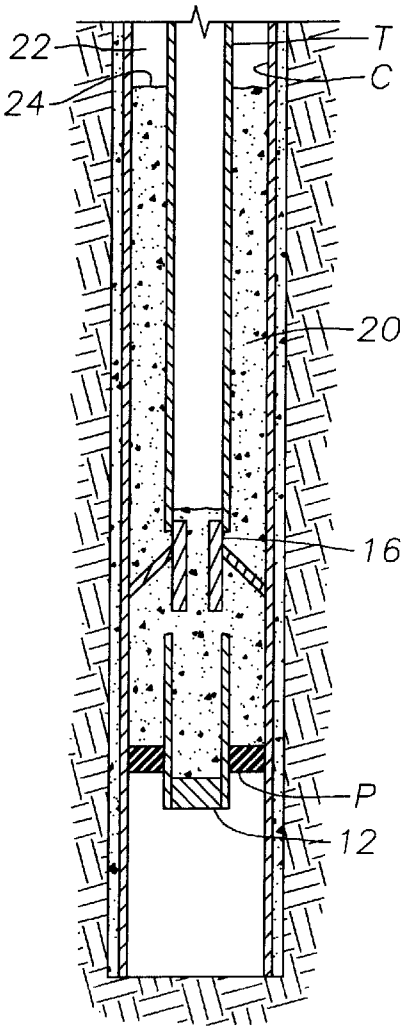
FIGS. 1B–1I are side schematic views in cross-section showing a method according to the present invention.
Figure 1C:
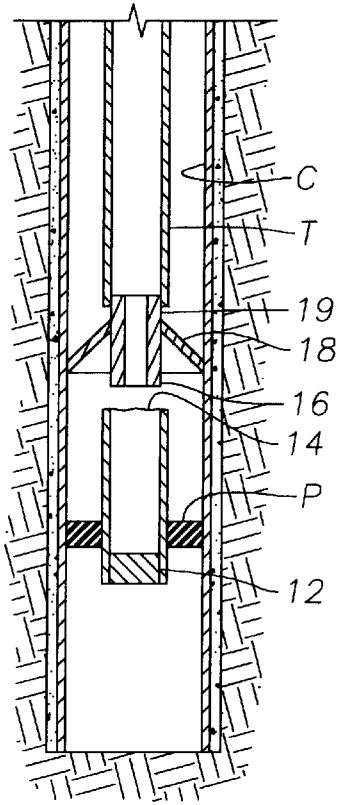
Figure 1B:
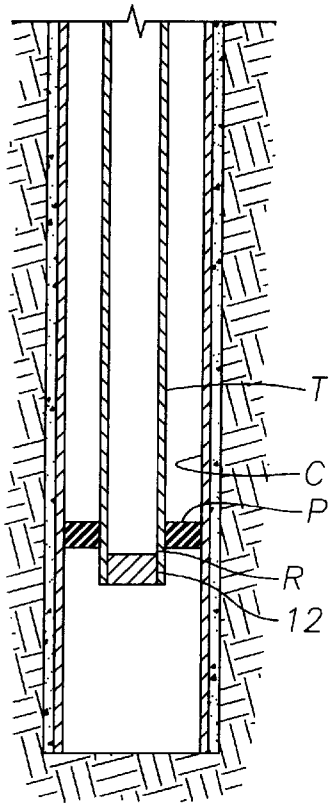
Figure 1A:
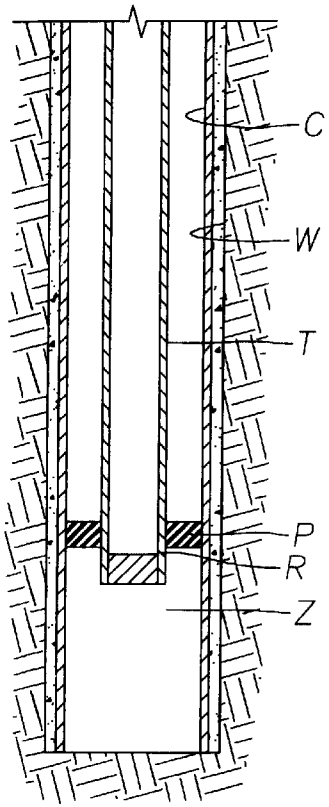
FIG. 1A is a side schematic cross-section view of a wellbore with a casing and tubing string therein.

Referring now to FIG. 1A, an earth wellbore W is cased with casing C extending down from the earth's surface to a completion zone Z from which, originally, desirable hydrocarbons are produced. Typical completion equipment is used for the zone Z. A tubing string T within the casing C has a lower end R that terminates above the completion zone Z. A packer P seals the tubing-casing annulus. For convenience the wellbore W, although present, is not shown in FIGS. 1B–1E and the lower end of the wellbore is also not shown in FIGS. 1B–1I.

As shown in FIGS. 1B–1H in a method according to the present invention, a system 10 is used to create an in-tubing lateral wellbore. As shown in FIG. 1B, the previously open lower end R of the tubing T is sealed with a sealing apparatus 12 to prevent fluid flow therethrough. This sealing apparatus may be any known suitable device, e.g. a packer or a plug. The sealing apparatus 12 may be installed using a wireline, coiled tubing, another jointed pipe or tubing string movable through the tubing string T.

As shown in FIG. 1C an opening 14 has been made through the tubing T (e.g. made by milling, with explosives or with a perforation device) and, optionally, a centralizing device 16 has been installed which is anchored within the tubing T. The centralizing device 16 has arms 18 which contact the casing C and centralize and stabilize the tubing T. The arms 18 are originally collapsed so that the centralizing device 16 is movable down through the tubing, e.g. on coiled tubing, on a wireline or on another tubing string. The arms expand to centralize the tubing T, particularly in an inclined wellbore if the tubing T is off-center with respect to the casing and/or laying against the casing. A body 19 of the device 16 is hollow permitting fluid flow therethrough.

As shown in FIG. 1D, wellbore cement 20 has been circulated down through the tubing T (or through a workstring within the tubing T such as a coiled tubing string), through the body 19 of the centralizing device 16, out through the opening 14, and into a tubing-casing annulus 22 to a level 24. The cement 20 is allowed to set to stabilize the portion of the tubing T encompassed by the cement 20. The cement 20: secures the lower end of the tubing T to the casing C preventing relative movement between the two; stabilizes the tubing T during subsequent milling or window formation operations; defines a circulation path down the coiled tubing and up the annulus for cuttings resulting from milling, drilling, or milling-drilling; and provides a borehole path from the interior of the tubing to the new wellbore exterior of the casing through which a completion can be run into a lateral wellbore. The cement stabilizes the tubing in the casing and closes or fills voids around the tubing exterior so that the flow path during later milling, drilling, and/or milling-drilling operations has a defined confined flow area of known size so that circulating fluid velocities can be sufficiently maintained to keep cuttings in suspension and moving up-hole.

Figure 1H:
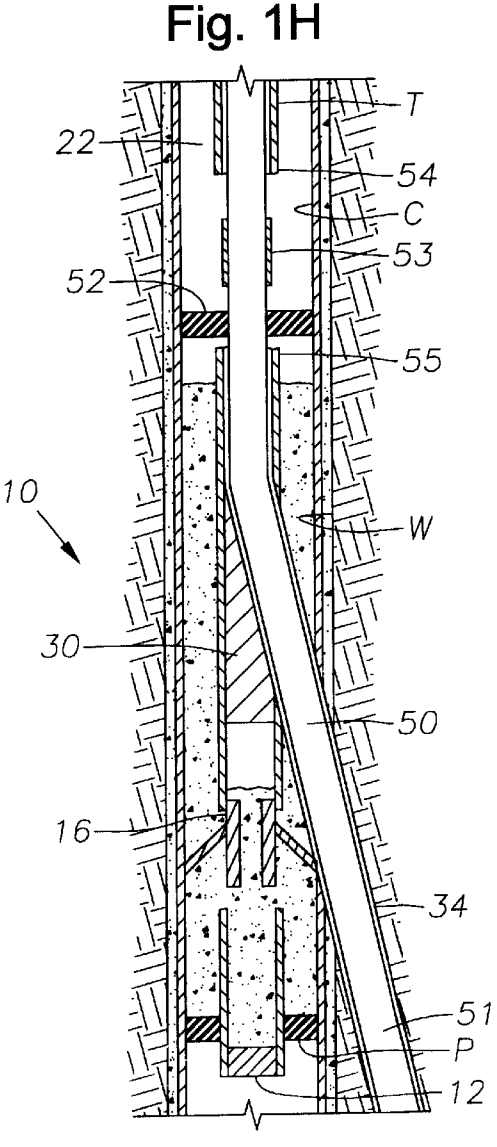
Figure 1G:
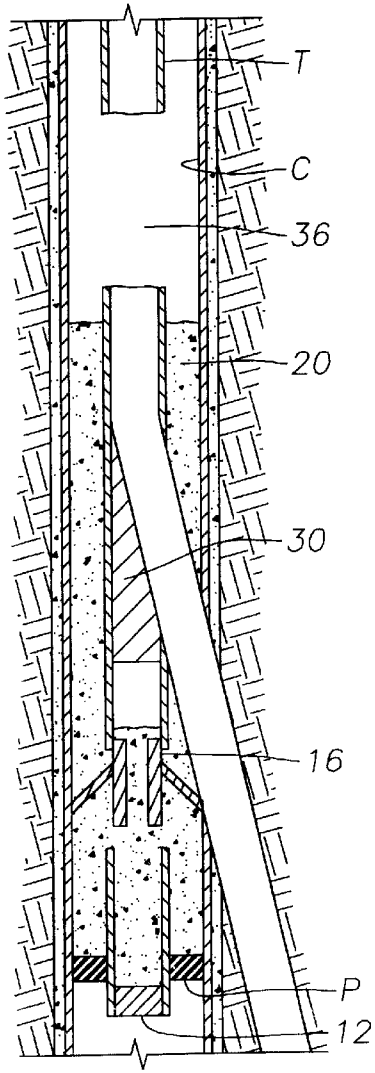
Figure 1F:
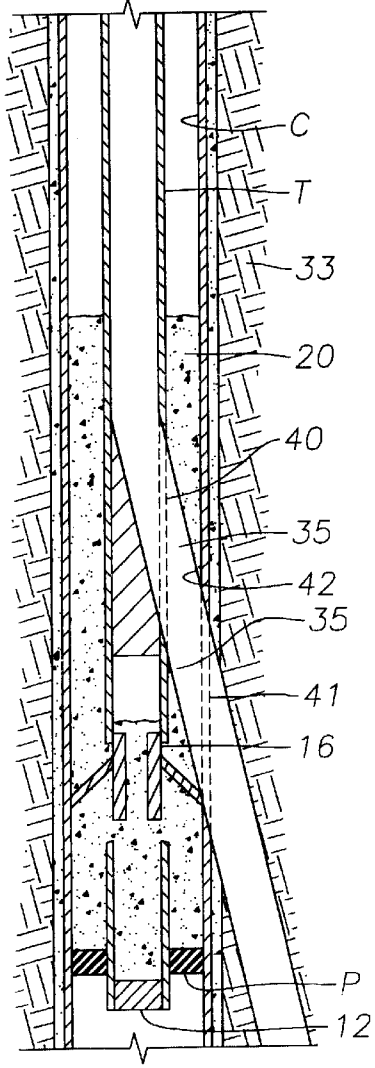
Figure 1E:
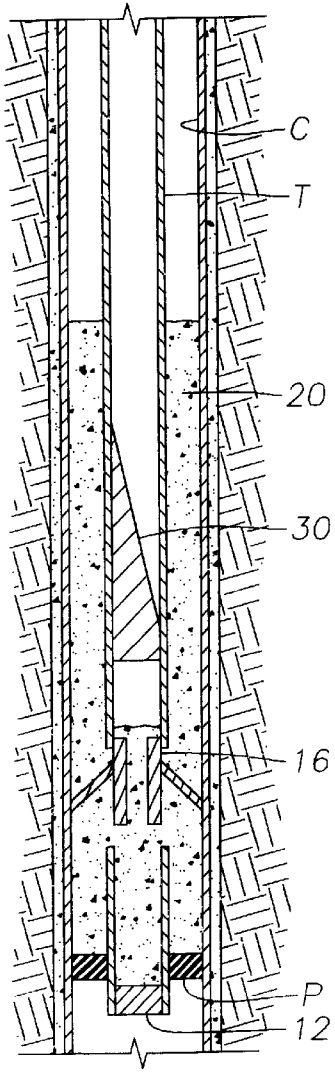

As shown in FIG. 1E a suitable guide, diverter, or whipstock 30 is run into the tubing T, e.g. on coiled tubing, wireline, or another tubing string, and anchored in place. Any suitable known guide, diverter, or whipstock may be used. Alternatively, openings to be made through the tubing T, cement 20, and casing C may be made with known explosives and explosive devices, with known chemicals and chemical devices, or with known jetting cutters. The guide, diverter, or whipstock may be a permanently set device, a retrievable device, or a millable device.

As shown in FIG. 1F, an opening or window 40 is milled through the tubing T with any suitable known mill or milling system, as is a window 41 through the casing C and an opening 42 through the cement 20. The mill or mill system may also progress into a formation 33 initiating a lateral wellbore 34. In one particular aspect, the lateral wellbore 34 is extended to any desired length employing suitable drilling and directional drilling apparatuses. In one aspect the open hole section 35 is underreamed to facilitate installation of a liner (in one aspect an expandable liner) in the lateral wellbore 34. Optionally, the whipstock 30 may now be removed.

As shown in FIG. 1G, a section 36 is cut out of the tubing T with any known suitable cutter or mill. As with the other devices used in the system 10, the cutter or mill may be used on coiled tubing, a wireline, or another tubing string. Alternatively the section, according to the present invention, can be removed with known suitable explosives and explosive devices, chemicals and chemical devices, and/or with known jetting cutters.

As shown in FIG. 1H, a liner 50 is installed with its lower end 51 extending into the lateral wellbore 34. A sealing apparatus 52, including but not limited to any suitable known through-tubing packer, is installed to seal off the tubing-casing annulus 22. In certain preferred embodiments the sealing apparatus provides a primary barrier. An expansion joint 53 (or polished bore receptacle and seal assembly) located between tubing end 54 and sealing apparatus 52 accommodates relative movement between the two, e.g., but not limited to, during subsequent production and injection (e.g. injection of water or gas in an injection well). The top of the lateral liner may be dropped off outside the window opening and, optionally, not connected to the original tubing or casing. Alternatively it may be attached to the tubing end 54 with a travel joint 53 and packer 52 all secured to the top end of the liner 50. Optionally, cement may be emplaced on top of the apparatus 52.

Figure 1I:
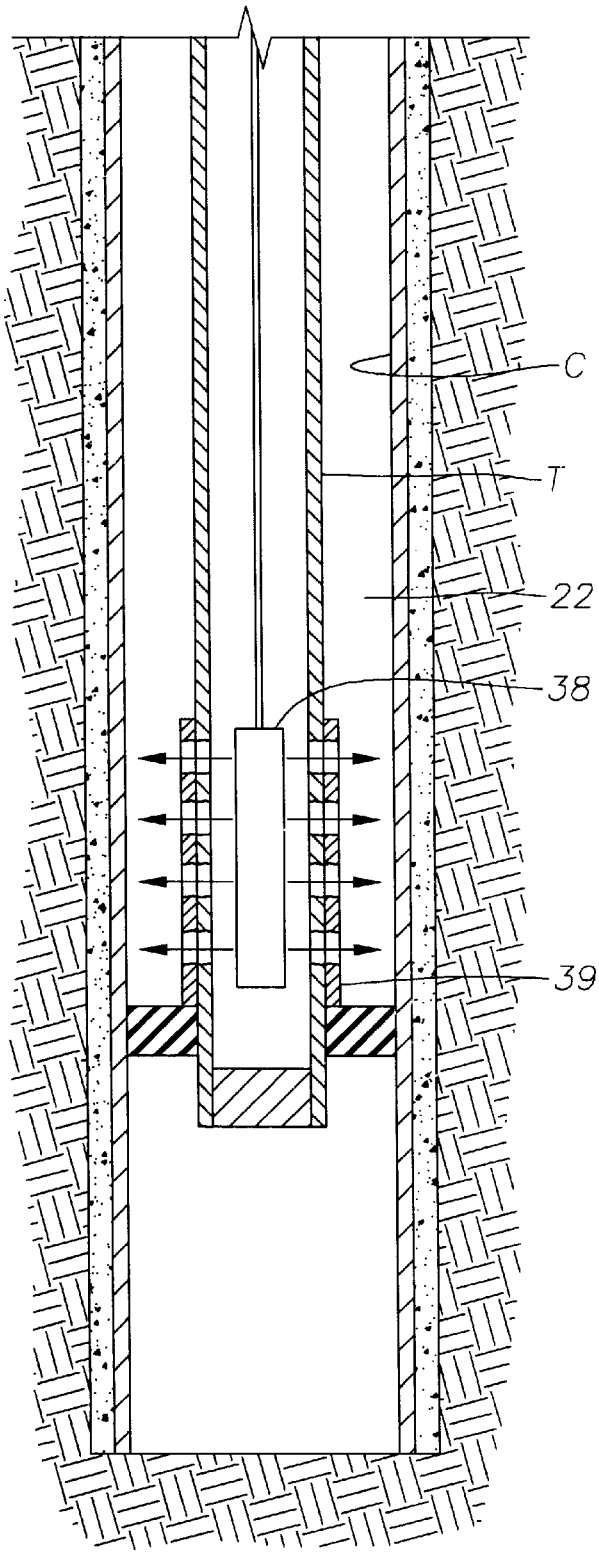

FIG. 1I shows schematically an alternative way to cement the tubing-casing annulus 22 in which a perforation device 38 (e.g. any known suitable perforator or perforating gun) perforates through the tubing T (and through an optional travelling joint 39 if one is present; such a joint may be used in the method of FIG. 1B). As in FIG. 1D, cement is then circulated through the resulting perforation or perforations into the annulus 22. The method shown in FIG. 1I does not require the devices 16 or the formation of the opening 14. The casing is, preferably, not perforated.

Figure 2:
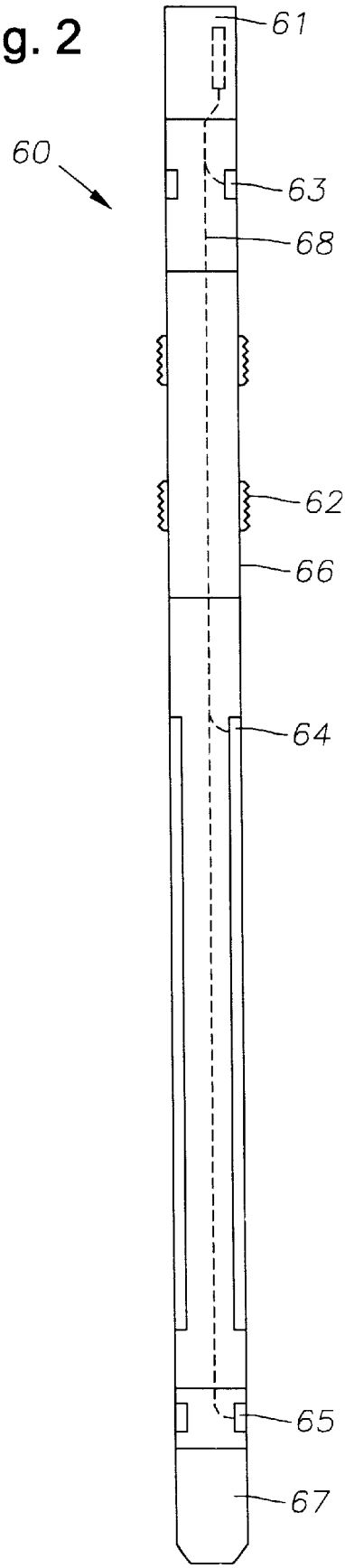
FIG. 2 is a side schematic cross-section view of a wellbore cutting system according to the present invention.

FIG. 2 illustrates schematically a tubing cutter system 60 according to the present invention useful in methods according to the present invention described below. The system 60 includes a selectively activatable firing initiator or head 61, selectively activatable securement apparatus 62; explosives 63, 64, and 65; a housing 66; and a lower end 67. The securement apparatus 62 may be any suitable known wellbore anchoring apparatus or mechanism. As shown, a plurality of "button subs" (as previously mentioned herein) are used. The explosives 63 are used to sever a section of the tubing at an upper level; the explosives 65 for severing the section of tubing at a lower level; an the explosives 64 for producing a series of longitudinal slots and corresponding fingers around the severed tubing section. A detonation cord 68 interconnected between the head 61 and explosives provides for simultaneously firing of all the explosives.

Figure 3A:
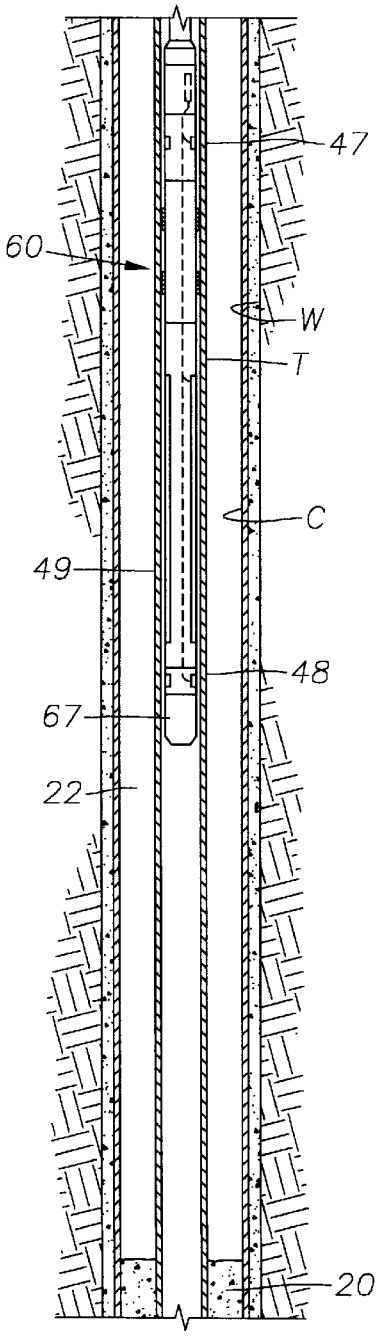
FIGS. 3A–3F are side schematic views in cross-section showing a method according to the present invention employing the system of FIG. 2.
Figure 3B:
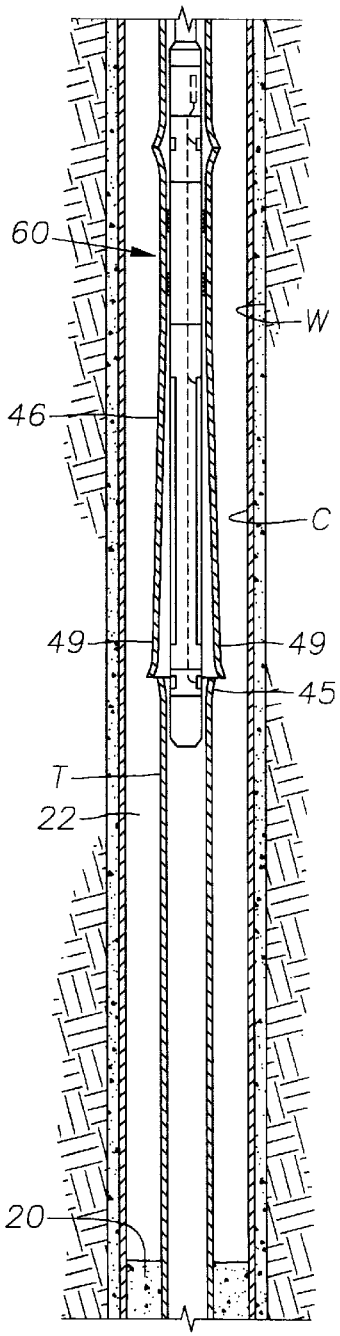
Figure 3C:
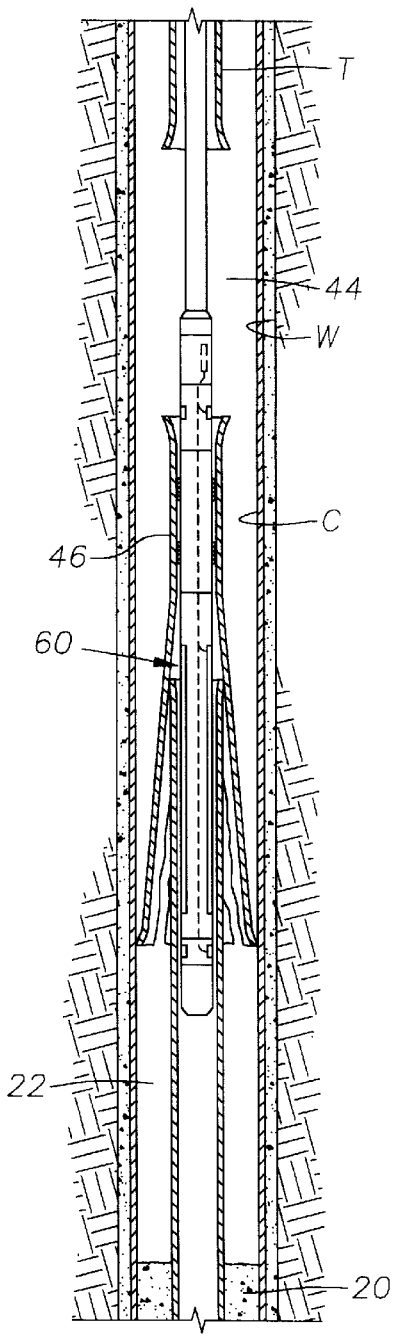

The system 60 is used, as shown in FIGS. 3A–3F to cut and move a section of the tubing T (e.g. the section 36 as shown in FIG. 1G). The system 60 is lowered within the tubing T to a desired location (it being understood that the wellbore W of FIG. 3A is the wellbore W of FIG. 1A and that the same completion zone Z, etc. are present). The firing head 61 is activated (e.g. by a fluid pressure pulse or by an electrical signal), firing the explosives 63, 64, 65. The tubing T is severed at a top level 47 and at a bottom level 48 creating a severed tubing section 46. Fingers 49 are formed with slots between them. The fingers 49 are free to move outwardly. As shown in FIG. 3B, lowering of the system 60, which is secured to the severed tubing section 46 by the securement apparatus 62, results in lowering of the severed tubing section 46. The lower ends of the fingers 49 encounter an upper end 45 of the tubing T and move outwardly as the system 60 and tubing section 46 are lowered (see FIG. 3C). optionally, a telescopically collapsing apparatus as disclosed in U.S. Pat. No. 4,905,759 may be used as the stroking movement apparatus to facilitate lowering of severed casing. The pressure differential across the stroking apparatus's piston then strokes the tubing section 46 downward without lowering the coiled tubing.

Figure 3D:
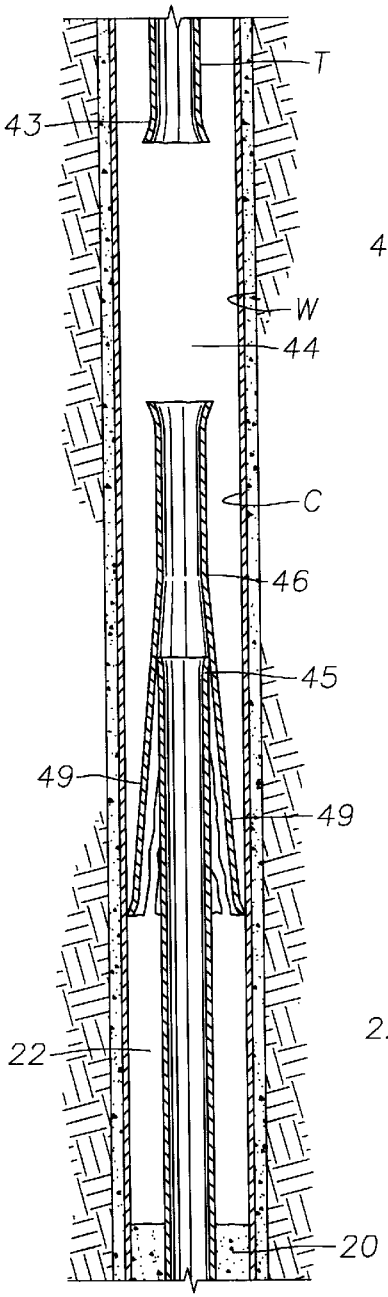
Figure 3E:
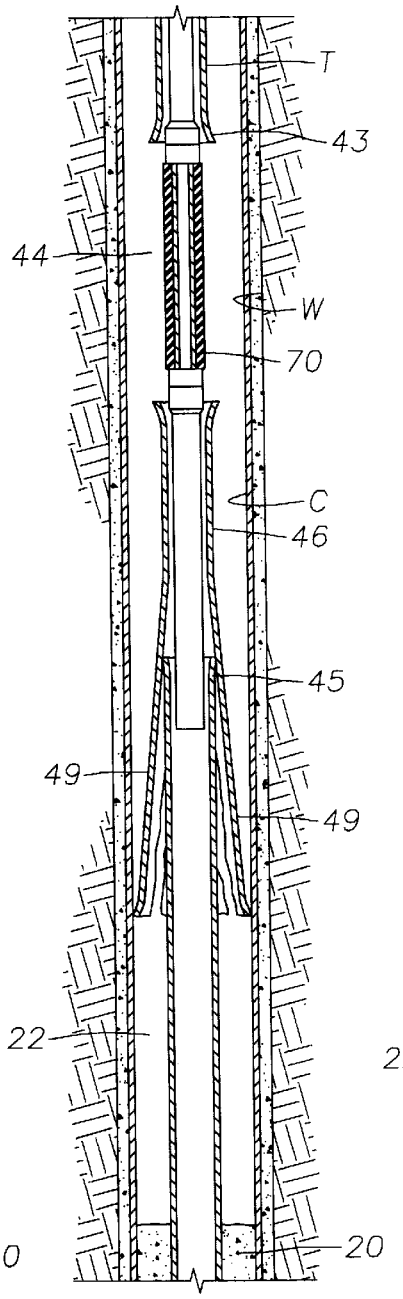
Figure 3F:
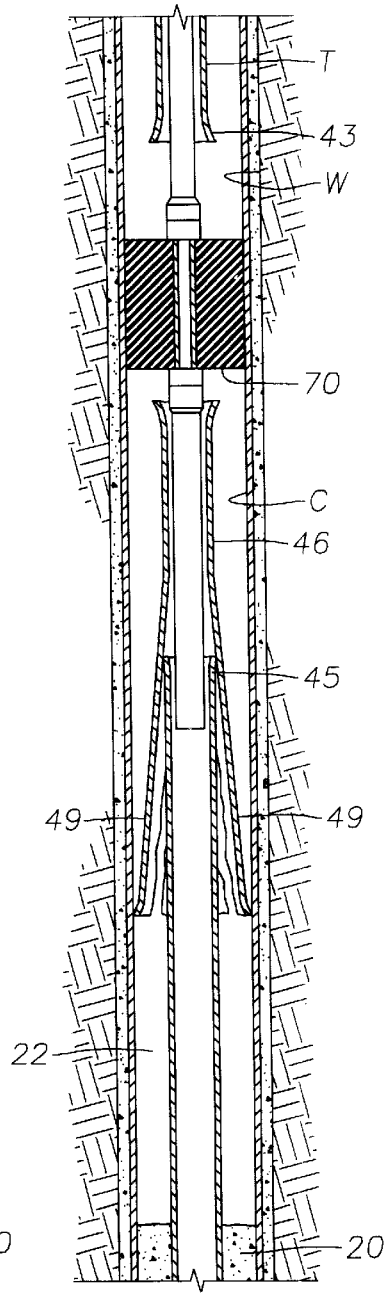
Figure 4A:
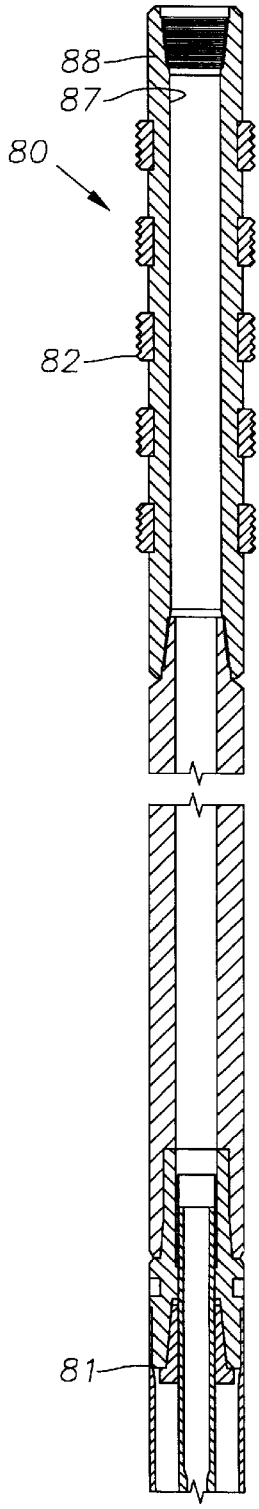
FIGS. 4A–4D are side schematic cross-section views of a wellbore cutting system according to the present invention.
Figure 4B:
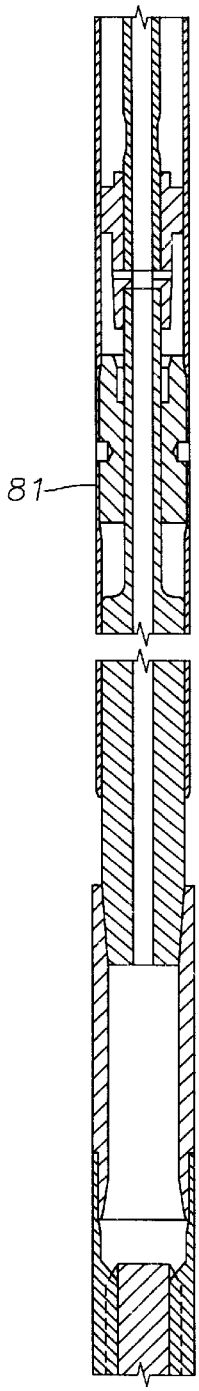
Figure 4C:
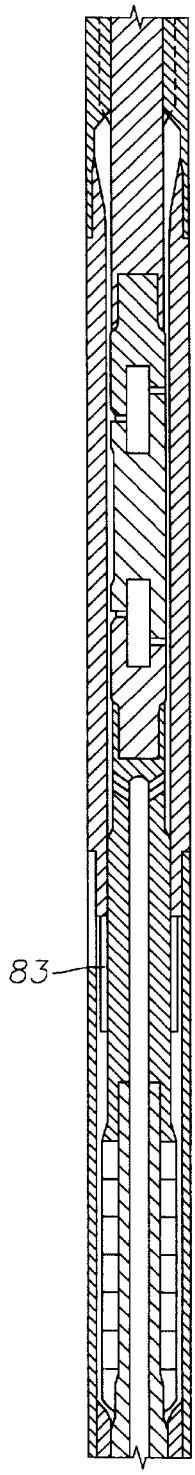
Figure 4D:
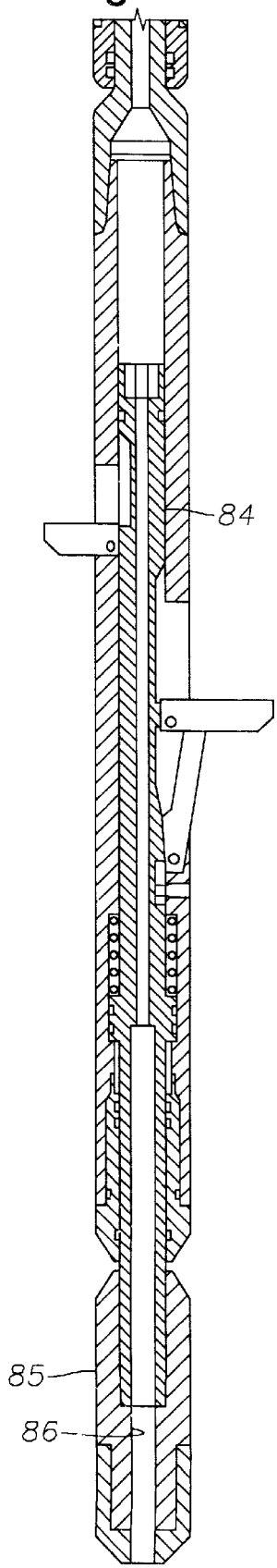

As shown in FIG. 3D, pressure has been relieved releasing the button subs and the system 60 has been removed and the severed tubing section 46 has been lowered to expose a desired gap 44 between ends 45 and 43 of the tubing T. As shown in FIG. 3E a selectively activatable sealing apparatus 70, (e.g. any suitable known sealing device, packer, etc.) is moved down through the tubing T and positioned between the tubing end 43 and a top end of the severed tubing section. As shown in FIG. 3F, the sealing apparatus 70 is activated to seal off the wellbore W. A tubular string or coiled tubing supporting the sealing apparatus 70 is released therefrom and retrieved from the wellbore.

FIGS. 4A–4D show a system 80 according to the present invention useful in severing a tubing section (and creating a gap in the tubing, e.g. as in FIG. 1G). The system 80 includes selectively activatable securement apparatus 82 for selectively anchoring the system 80 in tubing such as the tubing T; movement apparatus 81 for moving part of the system 80 upwardly; a downhole motor system 83 for rotating a mill system; and a mill system 84 for milling out the tubing section to create a desired gap therein. The system 80 has a lower end 85. Appropriate internal flow channels in the systems of the system 80 permit fluid to flow from the top to the bottom of the system to selectively activate the securement apparatus 82, to selectively activate and power the movement apparatus 81, to selectively activate and power the downhole motor system 83, and to selectively activate and power the mill system 84. Fluid may flow out from a channel 86 through the end 85.

The securement apparatuses 82 may be "button subs" as previously mentioned herein which are selectively activatable by pumping fluid under pressure down to the system 80 and through a channel 87 in a top sub 88 that is in fluid communication with fluid flow channels to the apparatuses 82.

The movement apparatus 81 may be any suitable downhole movement apparatus. In one aspect the movement apparatus is a stroke section mechanism as disclosed in U.S. application Ser. No. 09/183,943 filed Oct. 31, 1998, co-owned with the present invention and incorporated fully herein for all purposes.

The downhole motor system 83 is any suitable known downhole motor including, but not limited to a commercially available PDM motor or MacDrill motor of Rotech Holdings, Ltd.

The mill system 84 may be any known suitable mill or mill system, including, but not limited to, the tool of U.S. Pat. No. 5,735,359 issued Apr. 7, 1998, co-owned with the present invention and incorporated fully herein for all purposes.

Figure 5D:
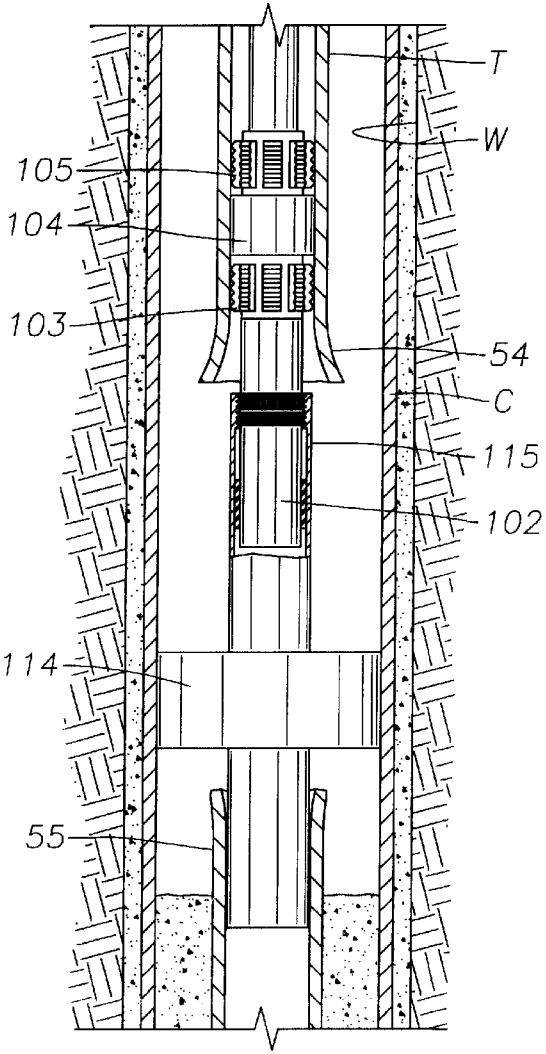
FIGS. 5C and 5D are side schematic views of a system according to the present invention using the apparatuses of FIGS. 5A and 5B.
Figure 5C:
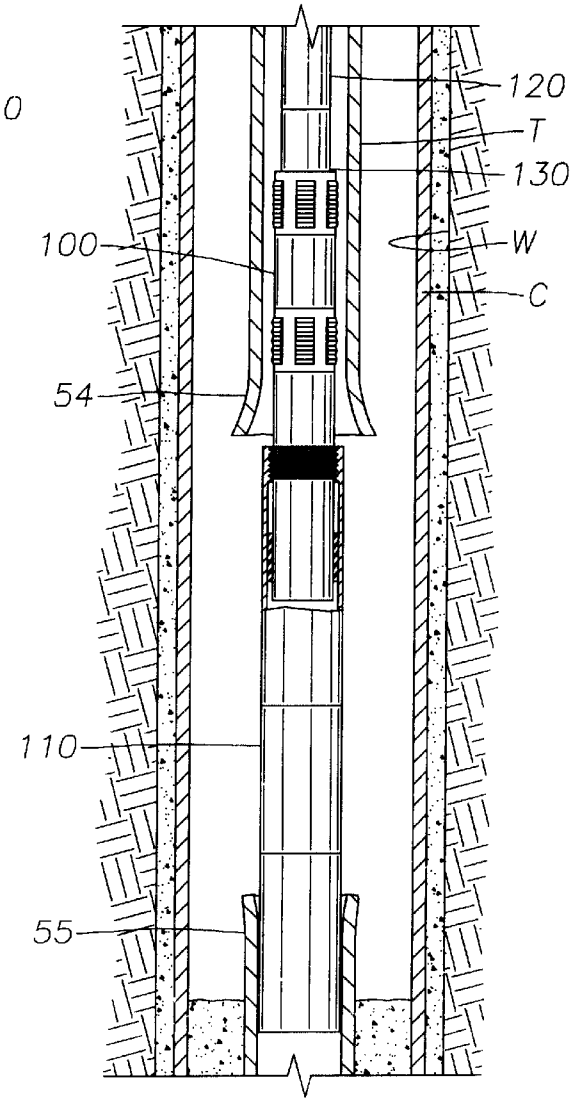
Figure 5B:
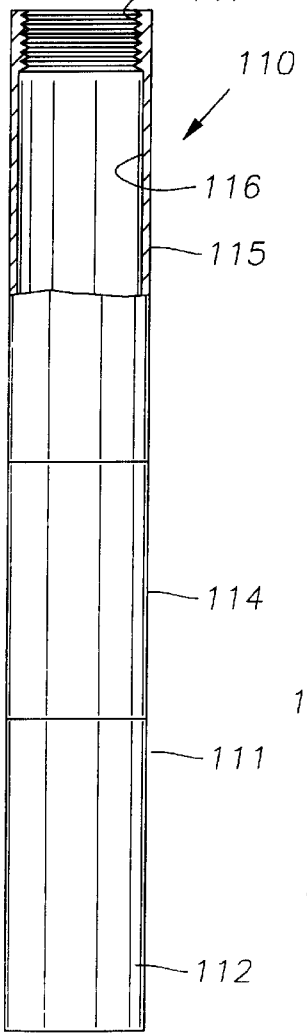
FIGS. 5A and 5B are side schematic views of a sealing apparatus for use with a system according to the present invention.
Figure 5A:
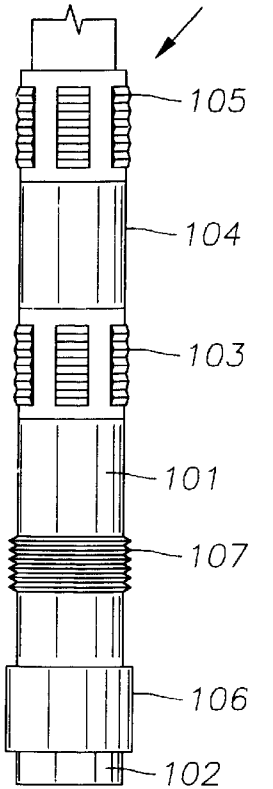

FIG. 5A shows a sealing apparatus 100 with a body 101, a lower end or "stinger" 102, lower slips 103 for engaging a tubing's interior, a packer element 104, upper slips 105 for engaging a tubing's interior, locking teeth or threads 107 (or with typical threads for threadedly engaging the apparatus 110), and seals 106.

FIG. 5B shows a sealing apparatus 110 with a body 111, a lower end or "stinger" 112, a packing element 114, with locking threads or teeth 117 for locking engagement with the teeth 107 of the apparatus 100 (or with typical threads) and a seal bore 115 with an interior surface 116.

As shown in FIG. 5C, the apparatuses of FIGS. 5A and 5B may be used to both provide the primary barrier above the end of the severed tubing 55 (created as in FIG. 1G above) and to seal off the annulus between the interior of the upper tubing end 54 and the exterior of the apparatus 100. The apparatus 100 is connected to and above the apparatus 110 and then the two are lowered on a tubular string, wireline, or coiled tubing 120 so that the stinger 112 of the apparatus 110 enters the lower severed tubing end 55. Optionally a running tool 130 may be used. The apparatuses are configured, sized and positioned so that the packing element 114 when activated provides a primary barrier across the casing C and the packing element 104 seals off the annulus between the interior of the tubing end 54 and the exterior of the apparatus 100.

As shown in FIG. 5D, the slips 103, 105 of the apparatus 100 have been selectively activated as is well known in the art to anchor the apparatus 100 in place in the tubing end 54; the stinger 102 has sealingly engaged the seal bore 115; the packing elements 104 and 114 have been selectively activated to effect the desired sealing; and the string 120 has been released from the apparatus 100 and retrieved from the wellbore W.

Alternatively, the apparatus 110 may be moved into the wellbore and located as shown in FIG. 5C and its packing element activated. Then the apparatus 100 is lowered and positioned as shown in FIG. 5C and its packing element is activated. The tubular string (wireline, coiled tubing) 120 is then released from the apparatus 100.

Each of the elements of the sytem described above has a fluid flow channel therethrough from top to bottom to provide fluid pumoped through the surface through the apparatus 100, through the apparatus 110, and down into the tubing 55 and therebelow selectively as desired. Either sealing apparatus in any system disclosed herein may have appropriate landing surfaces or landing nipples for receiving plugs or other apparatus pumped onto them. These plugs may be any known suitable plug, with or without anti-rotating structure, and/or they may be retrievable and/or drillable.

The present invention, therefore, provides in certain, but not necessarily all embodiments, a method for wellbore operations in an earth wellbore with tubing within casing in an earth wellbore, the wellbore extending down into earth from an earth surface, the tubing including a tubing string with a lower end and extending down within the casing with the lower end at a point above a lower end of the casing, a tubing-casing annulus between the tubing and the casing sealed by a first sealing apparatus, the method including sealing the lower end of the tubing string with a sealing device to prevent fluid flow therethrough, and sealing the tubing-casing annulus with a second sealing apparatus above and spaced apart from the first sealing apparatus. Such a method may include one, some (in any possible combination) or all of the following: making an exit opening or openings through the tubing and an exit opening or openings through the casing, each exit opening located above the first sealing apparatus; stabilizing the tubing at a location above the first sealing apparatus; perforating the tubing string at a level above a level of the first sealing apparatus producing at least one perforation, introducing a hardenable material into the tubing-casing annulus through the at least one perforation and flowing the hardenable material within said annulus up to a level spaced-apart from and above the level of the first sealing apparatus; hardening the hardenable material; wherein the hardenable material is cement; wherein the at least one perforation is a plurality of perforations; wherein the wellbore includes a first completion zone located below the lower end of the tubing; wherein the second sealing apparatus is a primary barrier; the first sealing device and the second sealing apparatus constitute a primary barrier; wherein, prior to sealing the tubing-casing annulus with the second sealing apparatus, the method includes removing a section of the tubing above the first sealing apparatus, moving the second sealing apparatus down through the tubing to the area from which the section of tubing has been removed, and activating the second sealing apparatus to seal off the tubing-casing annulus; wherein the exit opening or openings are made with a mill; wherein the mill is on a tubular string extending from the earth surface and the mill is rotated for milling by the tubular string; the mill is moved downwardly by moving the tubular string downwardly or the mill is moved upwardly by moving the tubular string upwardly, or both; wherein the mill is connected to a downhole motor on a tubular string in the wellbore and the downhole motor rotates the mill for milling and wherein the mill is moved downwardly by moving the tubular string downwardly or wherein the mill is moved upwardly by moving the tubular string upwardly, or both; wherein the downhole motor is interconnected with movement apparatus that is anchorable in the tubing at a point below the earth surface, the movement apparatus for moving, upwardly and/or downwardly, the downhole motor and mill during milling; wherein the downhole motor is interconnected with movement apparatus anchorable in the tubing at a point below the earth surface, the movement apparatus for moving the downhole motor and the mill upwardly and/or downwardly during milling; wherein the section of tubing is made by explosive means for severing the tubing at two spaced-apart locations; wherein the explosive means is on a movable tubular string on the wellbore and includes a securement apparatus securable within the tubing at the location of the section of tubing to be removed, the securement apparatus remaining secured with the section of tubing following severing of the tubing by the explosive means, the method including lowering the section of tubing to expose a gap in the tubing into which the second sealing apparatus may be moved; making a tubing opening in the tubing above the first sealing apparatus, installing a centralizer for centralizing the tubing within the casing, the centralizer having a hollow body through which hardenable material is pumpable out through the centralizer, through the tubing opening, and into the tubing-casing annulus; installing a whipstock within the tubing for directing a mill for making the exit opening(s); removing the whipstock after the exit openings are made; and/or drilling a lateral wellbore from the exit opening through the casing; installing a liner in at least a portion of the lateral wellbore.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. A method for completing an earth wellbore, the wellbore having a first production zone to be abandoned, and the wellbore having tubing extending down within casing therein and forming a tubing-casing annulus, the tubing having a lower end at a point above a lower end of the casing, and the tubing-casing annulus being sealed by a first sealing apparatus above the first production zone, the method comprising the steps of:

sealing the lower end of the tubing with a sealing device to prevent fluid flow therethrough;

creating a lower opening in the tubing above the first sealing apparatus;

inserting cement into the tubing-casing annulus through said lower opening in the tubing;

creating an exit opening through both the tubing and the casing above said lower end of the tubing;

forming said lateral wellbore through said exit opening;

severing the tubing above said lateral wellbore;

creating an upper opening in the tubing above said lateral wellbore, said tubing now having a new lower end above said lateral wellbore; and setting a second sealing apparatus in the wellbore above said lateral wellbore so as to sealing off the tubing-casing annulus.

2. The method for completing an earth wellbore of claim 1 wherein said second sealing apparatus provides a primary barrier to the first production zone.

3. The method for completing an earth wellbore of claim 1 wherein said step of creating an exit opening through both the tubing and the casing comprises the steps of:

affixing a mill onto the lower end of a tubular string;

lowering said tubular string into the tubing;

urging said mill against the tubing and the casing so as to mill a window through the tubing and the casing at a depth above said lower opening so as to form said exit opening and to begin a lateral wellbore; and removing said tubular string and mill.

4. The method for completing an earth wellbore of claim 3 further comprising the step of setting a diverter in the tubing at the depth desired for beginning said lateral wellbore before said lateral wellbore is formed; and wherein said step of urging said mill against the tubing and the casing further comprises the steps of:

rotating said mill; and moving said tubular string downward against said diverter thereby urging said mill against the production tubing and the casing so as to form said exit opening.

5. The method for completing an earth wellbore of claim 4 wherein said mill is rotated by a downhole motor on the tubular string in the wellbore.

6. The method for completing an earth wellbore of claim 4 wherein said mill is rotated by rotating the tubular string in the wellbore.

7. The method for completing an earth wellbore of claim 1 further comprising the step of running a liner through said severed tubing and into said lateral wellbore, said liner having an upper end and a lower end, said upper end essentially extending into said upper opening and being in fluid communication with the tubing.

8. The method for completing an earth wellbore of claim 7 wherein said second sealing apparatus is connected to said liner.

9. The method for completing an earth wellbore of claim 8 wherein said second sealing apparatus is a through-tubing packer, and is connected to said liner proximal to said upper end of said liner.

10. The method for completing an earth wellbore of claim 9 wherein said second sealing apparatus resides intermediate said upper end of said liner and said new lower end of the tubing.

11. The method for completing an earth wellbore of claim 9 wherein said upper end of said liner is sealingly placed in fluid communication with said new lower end of the tubing by means of an expansion joint so as to accommodate relative movement between said new lower end of the tubing and said second sealing apparatus.

12. The method for completing an earth wellbore of claim 11 wherein said expansion joint defines a polished bore receptacle and seal assembly.

13. The method for completing an earth wellbore of claim 1 wherein said step of creating a lower opening in the tubing above the first sealing apparatus comprises the steps of:

severing the tubing above the first sealing apparatus; and partially raising the tubing from the surface in order to create said lower opening between the tubing and the first sealing apparatus.

14. The method for completing an earth wellbore of claim 13 further comprising the step of stabilizing the tubing at a location above the first sealing apparatus before cement is inserted into the tubing-casing annulus.

15. The method for completing an earth wellbore of claim 14 wherein said step of stabilizing the tubing comprises lowering a centralizing device through the tubing and down to the lower end of the tubing, said centralizing device having arms and a hollow body for permitting fluid to flow therethrough; and activating said arms of said centralizing device against the casing so as to centralize the tubing at its lower end.

16. The method for completing an earth wellbore of claim 1 wherein the step of creating said lower opening in the tubing comprises the step of perforating the tubing at a level above the first sealing apparatus.

17. The method for completing an earth wellbore of claim 1 wherein the step of creating an upper opening in the tubing above said lateral wellbore is performed by partially raising the tubing from the surface.

18. The method for completing an earth wellbore of claim 1 wherein the step of creating an upper opening in the tubing above said lateral wellbore is performed by removing a section of tubing.

* * * * *

UNITED STATES PATENT AND TRADEMARK OFFICE

CERTIFICATE OF CORRECTION

PATENT NO. : 6,374,918 B2
DATED : April 23, 2002
INVENTOR(S) : Roberts et al.

It is certified that error appears in the above-identified patent and that said Letters Patent is hereby corrected as shown below:

Column 10,
Line 32, please change "to sealing" to -- to seal --.

Signed and Sealed this

Eighth Day of July, 2003

JAMES E. ROGAN
*Director of the United States Patent and Trademark Office*